US005671461A

United States Patent [19]

Ishii

[11] Patent Number: 5,671,461

[45] Date of Patent: Sep. 23, 1997

[54] TONER CARTRIDGE AVOIDING SPILLAGE OF TONERS

[75] Inventor: Tetsuichi Ishii, Yashio, Japan

[73] Assignee: Ricoh Company, Ltd., Tokyo, Japan

[21] Appl. No.: 546,136

[22] Filed: Oct. 20, 1995

[30] Foreign Application Priority Data

Oct. 21, 1994 [JP] Japan ..... 6-281571
Mar. 31, 1996 [JP] Japan ..... 7-153789

[51] Int. Cl.[6] ..... G03G 15/08

[52] U.S. Cl. ..... 399/27; 222/DIG. 1; 399/106; 399/120; 399/262

[58] Field of Search ..... 355/260, 215, 355/245; 222/DIG. 1; 399/24, 27–30, 58, 61–63, 103–106, 120, 258, 259, 260, 262

[56] References Cited

U.S. PATENT DOCUMENTS

| | | | |
|---|---|---|---|
| 4,254,202 | 3/1981 | Matsumoto et al. . | |
| 4,470,694 | 9/1984 | Murakami et al. . | |
| 4,518,248 | 5/1985 | Nishikawa . | |
| 4,888,620 | 12/1989 | Fujino et al. . | |
| 4,985,734 | 1/1991 | Honda et al. . | |
| 4,987,446 | 1/1991 | Machimaru et al. . | |
| 5,126,799 | 6/1992 | Matsuura et al. . | |
| 5,204,720 | 4/1993 | Ishida et al. . | |
| 5,268,720 | 12/1993 | Saitoh et al. . | |
| 5,298,952 | 3/1994 | Kamijo et al. . | |
| 5,315,357 | 5/1994 | Kamijo et al. . | |
| 5,331,377 | 7/1994 | Matsuura et al. . | |
| 5,349,425 | 9/1994 | Kamijo et al. . | |
| 5,363,177 | 11/1994 | Nakano et al. | 355/260 |
| 5,398,106 | 3/1995 | Eguchi | 399/110 |
| 5,475,479 | 12/1995 | Hatakeyama et al. | 355/260 |
| 5,489,747 | 2/1996 | Takenaka et al. . | |
| 5,499,077 | 3/1996 | Endo et al. | 399/27 |
| 5,568,233 | 10/1996 | Komada . | |

FOREIGN PATENT DOCUMENTS

| | | |
|---|---|---|
| 44 22 635 | 1/1981 | Germany . |
| 30 05 455 | 8/1981 | Germany . |
| 30 08 559 | 9/1981 | Germany . |
| 39 41 506 | 6/1990 | Germany . |
| 42 23 147 | 1/1993 | Germany . |
| 56-69676 | 6/1981 | Japan . |
| 62-269189 | 11/1987 | Japan . |
| 63-56676 | 3/1988 | Japan . |
| 1-76074 | 3/1989 | Japan . |

*Primary Examiner*—William J. Royer
*Attorney, Agent, or Firm*—Oblon, Spivak, McClelland, Maier & Neustadt, P.C.

[57] ABSTRACT

A toner cartridge includes a toner cartridge body formed with a toner outlet, and a shatter mechanism provided movably closing the toner outlet, the shatter mechanism including a shatter element having a free shutter edge defining a closed space between the shutter element and an outer surface of the toner cartridge body, wherein the shutter element further carries a member for preventing a spillage of toners accumulated in the space from the free shutter edge.

50 Claims, 8 Drawing Sheets

TONER CARTRIDGE AVOIDING SPILLAGE OF TONERS

BACKGROUND OF THE INVENTION

The present invention relates to a toner cartridge and a xerographic recording apparatus cooperating with such a toner cartridge.

Xerographic recording apparatuses form an electrostatic latent image on a photosensitive body according to an image to be recorded, wherein the electrostatic latent image thus formed is subsequently developed by applying toners upon the photosensitive body. A toner image thus formed on the photosensitive body is then transferred to a recording sheet as a visual image. Generally, such xerographic recording apparatuses use a toner cartridge for supplying toners.

FIGS. 1 and 2 show a conventional toner cartridge 1 in a cross sectional view.

Referring to FIGS. 1 and 2, the toner cartridge 1 is designed for detachable mounting upon a developing unit of a xerographic recording apparatus, and includes a toner cartridge body 1*a* and a toner tank 2 formed as a part of the cartridge body 1*a*. The toner tank 2 accommodates toners T therein. Further, the toner cartridge 1 includes a toner feed mechanism 3 for supplying the toners T from the cartridge body 1*a* to the developing unit of the xerographic recording apparatus, and an agitator 4 for agitating the toners T in the 1 toner tank 2. The agitator T further supplies the toners T to the toner feed mechanism 3.

The toner feed mechanism 3 includes a magnetic feed roller 5 for collecting the toners T supplied from the toner tank 2 by the agitator 4 by a magnetic attraction on a circumferential surface thereof, a rib 6 formed in engagement with the feed roller 5 for scraping off the toners T from the circumferential surface of the rotating feed roller 5, and a toner outlet 7 formed on the toner cartridge body 1*a* in the form of an opening for supplying the toners T scraped off by the rib 6 to the developing unit of the xerographic recording apparatus. Further, the toner cartridge 1 further carries thereon a movable shutter 8 that movably closes the toner outlet 7 along the outer surface of the toner cartridge body 1*a*. The movable shutter 8 is urged in the direction of an arrow A by a spring not illustrated and is actuated upon mounting and dismounting of the cartridge 1 to and from the developing unit of the xerographic recording apparatus. It should be noted that the shutter 8 moves between a closed position in which the toner outlet 7 is covered by the shutter 8 and an opened position in which the toner outlet is opened by the shutter 8.

As indicated in FIG. 3, the toner cartridge 1 of FIGS. 1 and 2 is mounted upon a base 14 of a developing unit 17 such that a tongue 8*a* of the movable shutter 8 engages with a corresponding rib 13 formed on the xerographic recording apparatus in the vicinity of the base 14, wherein the cartridge 1 is set upon the base 14 in the state that the foregoing shutter 8 is rotated in the direction of an arrow A about an axis 5*a*. In other words, FIG. 3 shows the shutter 8 in the opened state.

In the state where the cartridge 1 is correctly seated upon the base 14 of the developing unit 17 and the shutter 8 is opened as indicated in FIG. 3, the toner outlet 7 faces a corresponding toner inlet formed on a seat 12 of the developing unit 17.

In such a toner cartridge 1, the user of the xerographic recording apparatus may accidentally hit the apparatus by the cartridge 1 when replacing the cartridge. Further, there is a possibility that the user may drop the toner cartridge 1 accidentally. In such a case, the shutter 8 may be subjected to a violent shock that may cause a displacement of the shutter 8 in the direction of an arrow B as indicated in FIG. 2 as a result of the shock. In such a case, the toner accumulated in a gap 8*g*, formed between the cartridge body 1*a* and the shutter 8, may spill over the floor or desk from a free edge 8*e* of the shutter 8.

It should be noted that such a spillage of the toners may occur also when the shutter 8 is stuck to the seat 12 of the base 14. When the toner cartridge 1 is removed from the base 14 in such a state, the shutter 8 may be displaced and the toners accumulated in the gap 8*g* inevitably spill over the seat 12 of the developing unit 17 from the free edge 8*e* of the shutter 8.

SUMMARY OF THE INVENTION

Accordingly, it is a general object of the present invention to provide a novel and useful toner cartridge of a xerographic printer as well as a xerographic printer that uses such a toner cartridge, wherein the foregoing problems are eliminated.

Another and more specific object of the present invention is to provide a toner cartridge for use in a xerographic recording apparatus that effectively eliminates spillage of toners.

Another object of the present invention is to provide a toner cartridge of a xerographic recording apparatus, comprising:

a toner cartridge body for accommodating toners therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding said toners in said toner cartridge body to said toner inlet of said xerographic recording apparatus via said toner outlet; and a shatter mechanism provided on said toner cartridge body for movably closing said toner outlet, said shatter mechanism including a shatter element defined by a free shutter edge and is movable between a closed position and an opened position along an outer surface of said toner cartridge body over a part thereof that includes said toner outlet, such that said toner outlet is covered by said shutter element when in said closed state of said shutter element and such that said toner outlet is exposed when in said opened state of said shutter element, said free shutter edge engaging with a part of said toner cartridge body in said closed state thereof to define a closed space between said shutter element and said outer surface of said toner cartridge body, such that said shutter element prevents a spillage of said toners from said toner outlet;

wherein said shutter element further carries a member for preventing a spillage of said toners accumulated in said space between said shutter element and said outer surface of said toner cartridge body, from said free shutter edge.

Another object of the present invention is to provide a toner cartridge of a xerographic recording apparatus, comprising:

a toner cartridge body for accommodating toners therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding said toners in said toner cartridge body to said toner inlet of said xerographic recording apparatus via said toner outlet; and a shatter mechanism provided on said toner cartridge body for movably closing said toner outlet, said shatter mechanism including a shatter element defined by a free shutter edge and is movable between a closed position and an opened position along an outer surface of said toner cartridge body over a part of said toner cartridge body that includes said toner outlet, such that said toner outlet is covered by said shutter element when in said closed state of said shutter element and such that said toner outlet is exposed when in said opened state of said shutter element, said free shutter edge engaging with a part of said toner cartridge body in said closed state thereof to define a closed space between said shutter element and said outer surface of said toner cartridge body, such that said shutter element prevents a spillage of said toners from said toner outlet;

wherein said toner cartridge body further carries a member for engagement with said free shutter edge of said shutter element in said closed position of said shutter element, for preventing a spillage of said toners accumulated in said space between said shutter element and said outer surface of said toner tank, from said free shutter edge.

Another object of the present invention is to provide a toner cartridge of a xerographic recording apparatus, comprising:

a toner cartridge body for accommodating toners therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding said toners in said toner cartridge body to said toner inlet of said xerographic recording apparatus via said toner outlet; and a shatter mechanism provided on said toner cartridge body for movably closing said toner outlet, said shatter mechanism including a shatter element defined by a free shutter edge and is movable between a closed position and an opened position along an outer surface of said toner cartridge body over a part of said toner cartridge body that includes said toner outlet, such that said toner outlet is covered by said shutter element when in said closed state of said shutter element and such that said toner outlet is exposed when in said opened state of said shutter element, said free shutter edge engaging with a part of said toner cartridge body in said closed state thereof to define a closed space between said shutter element and said outer surface of said toner cartridge body, such that said shutter element prevents a spillage of said toners from said toner outlet;

wherein said toner cartridge body further carries a magnetic member on a part thereof located below a part of said toner cartridge body to which said free shutter edge of said shutter element engages in said closed state of said shutter element, said magnetic member thereby collecting said toners spilled from said free shutter edge of said shutter element.

Another object of the present invention is to provide a toner cartridge of a xerographic recording apparatus, comprising:

a toner cartridge body for accommodating toners therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding said toners in said toner cartridge body to said toner inlet of said xerographic recording apparatus via said toner outlet;

a shatter mechanism provided on said toner cartridge body for movably closing said toner outlet, said shatter mechanism including a shatter element defined by a free shutter edge and is movable between a closed position and an opened position along an outer surface of said toner cartridge body over a part thereof that includes said toner outlet, such that said toner outlet is covered by said shutter element when in said closed state of said shutter element and such that said toner outlet is exposed when in said opened state of said shutter element, said free shutter edge engaging with a part of said toner cartridge body in said closed state thereof to define a closed space between said shutter element and said outer surface of said toner cartridge body, such that said shutter element prevents a spillage of said toners from said toner outlet; and a seal tape provided removably upon said toner cartridge body for closing said toner outlet, said seal tape having a free tab region for allowing a use to pull when removing said seal tape;

wherein said shutter element further carries a member for engagement with said seal tape for scraping off toners attached to said seal tape into said space between said shutter element and said toner cartridge body when said seal tape is pulled at said tab.

Another object of the present invention is to provide a xerographic recording apparatus, comprising:

a photosensitive body for carrying an electrostatic latent image thereon;

an optical system for writing an electrostatic latent image upon said photosensitive body;

a precharging unit for precharging the photosensitive body;

a developing unit for developing the electrostatic latent image on said photosensitive body in the form of a toner image;

transfer unit for transferring and fixing said toner image on said photosensitive drum upon a recording sheet; and a sheet feed mechanism for feeding a recording sheet to said transfer unit for recording of said toner image, said sheet feed mechanism further discharging said recording sheet after recording of said toner image;

said xerographic recording apparatus being adapted for engaging with a toner cartridge mounted thereupon, said toner cartridge comprising:

a toner cartridge body for accommodating toners therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding said toners in said toner cartridge body to said toner inlet of said xerographic recording apparatus via said toner outlet; and a shatter mechanism provided on said toner cartridge body for movably closing said toner outlet, said shatter mechanism including a shatter element defined by a free shutter edge and is movable between a closed position and an opened position along an outer surface of said toner cartridge body over a part thereof that includes said toner outlet, such that said toner outlet is covered by said shutter element when in said closed state of said shutter element and such that said toner outlet is exposed when in said opened state of said shutter element, said free shutter edge engaging with a part of said toner cartridge body in said closed state thereof to define a closed space between said shutter element and said outer surface of said toner cartridge body, such that said shutter element prevents a spillage of said toners from said toner outlet;

said shutter element carrying a member for preventing a spillage of said toners accumulated in said space between said shutter element and said outer surface of said toner cartridge body, from said free shutter edge.

Another object of the present invention is to provide a xerographic recording apparatus, comprising:

a photosensitive body for carrying an electrostatic latent image thereon;

an optical system for writing an electrostatic latent image upon said photosensitive body;

a precharging unit for precharging the photosensitive body;

a developing unit for developing the electrostatic latent image on said photosensitive body in the form of a toner image;

transfer unit for transferring and fixing said toner image on said photosensitive drum upon a recording sheet; and a sheet feed mechanism for feeding a recording sheet to said transfer unit for recording of said toner image, said sheet feed mechanism further discharging said recording sheet after recording of said toner image;

said xerographic recording apparatus being adapted for engaging with a toner cartridge mounted thereupon, said toner cartridge comprising:

a toner cartridge body for accommodating toners therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding said toners in said toner cartridge body to said toner inlet of said xerographic recording apparatus via said toner outlet; and a shatter mechanism provided on said toner cartridge body for movably closing said toner outlet, said shatter mechanism including a shatter element defined by a free shutter edge and is movable between a closed position and an opened position along an outer surface of said toner cartridge body over a part of said toner cartridge body that includes said toner outlet, such that said toner outlet is covered by said shutter element when in said closed state of said shutter element and such that said toner outlet is exposed when in said opened state of said shutter element, said free shutter edge engaging with a part of said toner cartridge body in said closed state thereof to define a closed space between said shutter element and said outer surface of said toner cartridge body, such that said shutter element prevents a spillage of said toners from said toner outlet;

said toner cartridge body carrying an elastic member for engagement with said free shutter edge of said shutter element in said closed position of said shutter element, for preventing a spillage of said toners accumulated in said space between said shutter element and said outer surface of said toner tank, from said free shutter edge.

Another object of the present invention is to provide a xerographic recording apparatus, comprising:

a photosensitive body for carrying an electrostatic latent image thereon;

an optical system for writing an electrostatic latent image upon said photosensitive body;

a precharging unit for precharging the photosensitive body;

a developing unit for developing the electrostatic latent image on said photosensitive body in the form of a toner image;

transfer unit for transferring and fixing said toner image on said photosensitive drum upon a recording sheet; and a sheet feed mechanism for feeding a recording sheet to said transfer unit for recording of said toner image, said sheet feed mechanism further discharging said recording sheet after recording of said toner image;

said xerographic recording apparatus having a seat for engaging with a toner cartridge mounted thereupon, said toner cartridge comprising:

a toner cartridge body for accommodating toners therein, said toner cartridge body having a shape in conformity with a shape of said seat of said xerographic recording apparatus;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding said toners in said toner cartridge body to said toner inlet of said xerographic recording apparatus via said toner outlet; and a shatter mechanism provided on said toner cartridge body for movably closing said toner outlet; and a magnetic member provided on a part of said toner cartridge body that faces said seat, for capturing toners falling through a gap formed between said toner cartridge body and said seat.

According to the present invention, the problem of spillage of the toners accumulated between the toner cartridge and the shutter element of the cartridge at the time of shock or jolt of the shutter element is successfully eliminated by provided a member that prevents spillage of the toners from the free shutter edge of the shutter element.

Other objects and further features of the present invention will become apparent from the following detailed description when read in conjunction with the attached drawings.

DETAILED DESCRIPTION OF THE PREFERRED EMBODIMENTS

Figure 4:
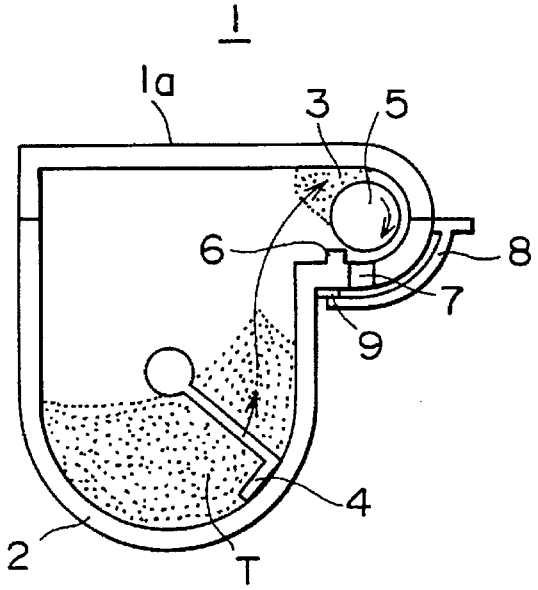
FIG. 4 is a diagram showing the construction of a toner cartridge according to a first embodiment of the present invention.
Figure 5:
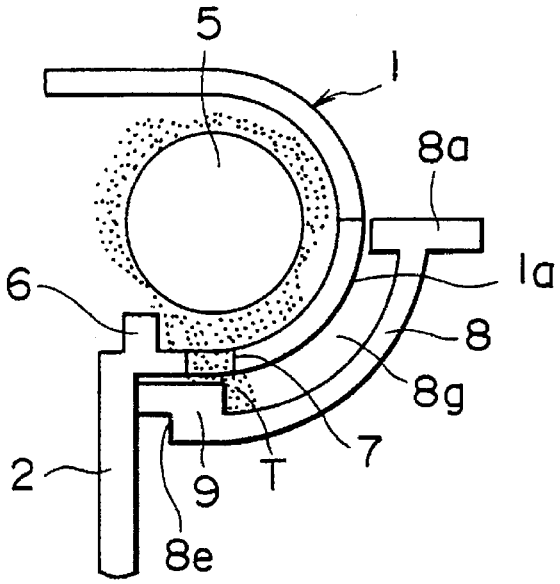
FIG. 5 is a diagram showing the toner cartridge of FIG. 4 in detail.

FIG. 4 shows the toner cartridge according to a first embodiment of the present invention while FIG. 5 shows a part of FIG. 4 in detail. In FIGS. 4 and 5, it should be noted that those parts corresponding to the parts described previously are designated by the same reference numerals and the description thereof will be omitted.

Referring to FIGS. 4 and 5, it will be noted that the shutter 8 now carries a ridge member 9 at the free edge 8*e* at the side facing the outer surface of the toner cartridge body 1*a*, wherein the ridge member 9 is formed integrally to the shutter 8 and engages with the outer surface of the cartridge body 1*a* along which the shutter 8 is moved between the closed position and the opened position. Thereby, it will be noted that the toners T spilled from the outlet 7 and held by the shutter 8 that closes the toner outlet 7, are secured within the space 8*g* by the ridge member 9 at the free edge 8*e* of the shutter 8, and no leak of the toners T occurs even when the shutter 8 is subjected to a shock or jolt. As the ridge member 9 is formed only at the free edge 8*e* of the shutter 8, the friction caused by the ridge member 9 engaging with the outer surface of the cartridge body 1*a* is held minimum, and the opening and closing of the shutter 8 is achieved smoothly upon mounting and dismounting of the toner cartridge 1 to and from the xerographic recording apparatus. As will be noted from FIG. 5, the ridge member 9 engages with the outer surface of the tank 2 in the nominal closed state of the shutter 8.

In the embodiment of FIG. 5, one may use an elastic material such as sponge, foam rubber or fabric such as felt also for the ridge member 9. By doing so, the shock applied to the cartridge 1 is effectively absorbed by the ridge member 9, and the problem of accidental disengagement of the ridge member 9 from the toner tank 2 is effectively eliminated. Thereby, the security of the toner cartridge against accidental spillage of the toners is further improved. In this case, the material of the ridge member 9 may be different from the material forming the shutter 8.

Figure 6:
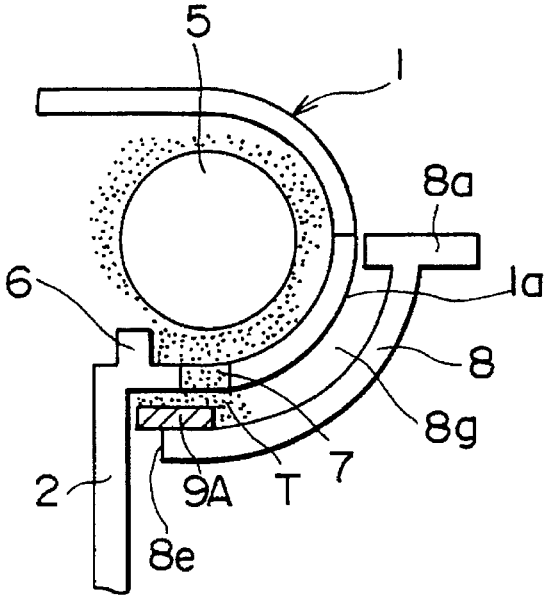
FIG. 6 is a diagram showing a modification of the toner cartridge of FIGS. 4 and 5.

FIG. 6 shows a modification of the embodiment of FIGS. 4 and 5, wherein the toner cartridge of FIG. 5 uses a magnetic member 9A in place of the integral ridge member 9. In this case, the toners spilled into the space 8*g* are collected by the magnetic member 9A, and the spillage of the toners T out from the space 8*g* is effectively eliminated by the magnetic member 9A. The construction of FIG. 6 has a further advantageous feature in that the magnetic member 9A collects the toners already spilled upon the seat 12 of the developing unit 17 when the toner cartridge 1 is mounted upon the xerographic recording apparatus and the shutter 8 is opened. In such a case, it will be noted that the magnet 9A sweeps over the seat 12 of the developing unit 17 with the gradual movement of the shutter 8 to expose the toner outlet 7. A similar sweeping is made also when dismounting the cartridge 1 from the xerographic recording apparatus.

In the present embodiment, too, one may use an elastic, flexible magnetic material for the magnetic member 9A. Such a flexible magnetic material includes rubber magnetic sheet N1400 supplied from Sumitomo 3M.

Figure 7:
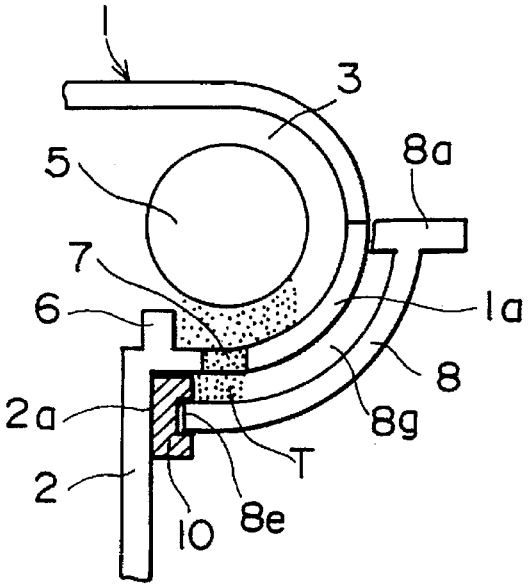
FIG. 7 is a diagram showing the construction of a toner cartridge according to a second embodiment of the present invention.

FIG. 7 shows a second embodiment of the present invention. In FIG. 7, those parts corresponding to the parts described previously are designated by the same reference numerals and the description thereof will be omitted.

Referring to FIG. 7, the toner cartridge body 1*a* now carries an elastic stopper member 10 on an outer surface 2*a* of the toner tank 2 where the free edge 8*e* of the shutter 8 engages. The elastic stopper member 10 is formed of an elastic material such as sponge, foam rubber or fabric such as a felt, and deforms flexibly upon engagement of the shutter 8. Thus, the free edge 8*e* of the shutter 8, which is urged by a spring not illustrated, cuts into the stopper member 10, and the engagement between the stopper member 10 and the free edge 8*e* of the shutter 8 is maintained even when the shutter 8 is displaced by a shock applied to the cartridge 1. In other words, the toners T held in the space 8*g* never spills out even when the toner cartridge 1 is subjected to a violent shock or jolt. Further, the construction of FIG. 7 allows to use the components of the toner cartridge 1, such as the toner tank 2 and the shutter 8, to be formed with less precision, as the error in the outer dimension of the components may be adjusted or absorbed by the deformation of the elastic stopper member 10.

Further, it should be noted that the elastic stopper member 10 absorbs shock applied to the cartridge 1. Thereby, the shock attenuates immediately and the transmission of the shock applied to from the cartridge body 1*a* to the shutter 8 is effectively suppressed. One may of course form the stopper member 10 of a flexible magnetic material such as a magnetic sheet for collecting the spilled toners.

Figure 8:
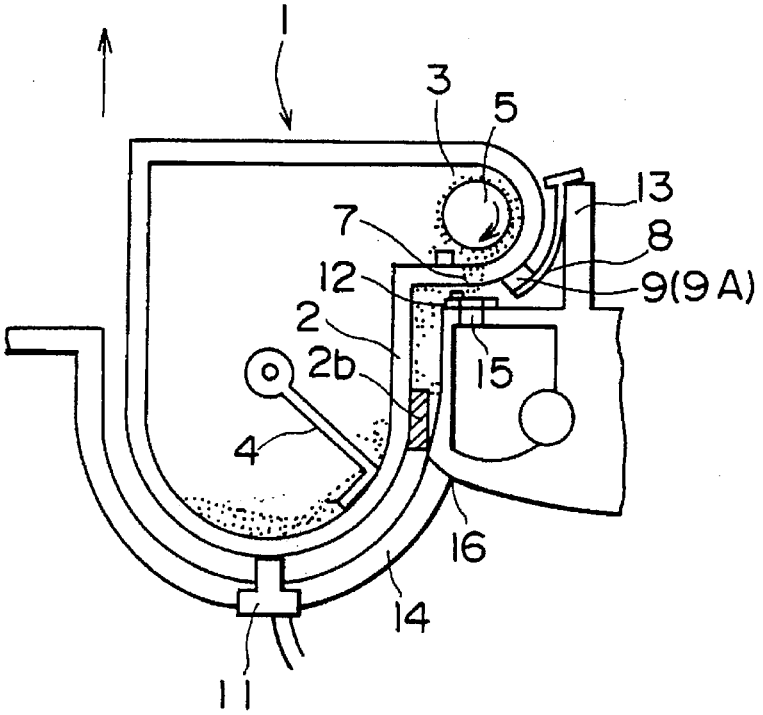
FIG. 8 is a diagram showing the construction of the toner cartridge according to a third embodiment of the present invention.

FIG. 8 shows a third embodiment of the present invention. In FIG. 8, those parts corresponding to the parts described previously are designated by the same reference numerals and the description thereof will be omitted. It should be noted that FIG. 8 shows the toner cartridge 1 mounted upon the base 14 of the developing unit 17 of the xerographic recording apparatus in the state that the shutter 8 is opened and the toner outlet 7 exposed. The shutter 8 has a construction described with reference to FIG. 5 or 6 and carries the ridge member 9 or the magnetic member 9A. Further, it will be noted that a toner end sensor 11 is provided on the bottom of the base 14 for detecting a toner low state of the cartridge 1.

Referring to FIG. 8, it will be noted that a magnet 16 is provided on an outer surface 2*b* of the toner tank 2 at a location below the toner outlet 7, such that the magnet 16 blocks the passage of the toners spilled from the toner outlet 7 onto the seat 12 of the toner outlet 7 and falling therefrom further to the bottom of the base 14. It should be noted that the passage of the spilled toners is formed between the outer surface 2*b* of the toner tank 2 and a corresponding surface of the base 14 of the developing unit 17. Thus, the falling toners are effectively captured by the magnet 16 by the magnetic attraction thereof. Thereby, it is not necessary to form the magnet 16 such that the magnet 2*b* completely blocks the space formed between the outer surface 2*b* of the toner tank 2 and the corresponding surface of the base 14, as long as the gap formed between the magnet 2*b* and the surface of the base 14 is small enough for the magnet 16 to capture the toners falling through such a gap. By providing the magnet 16 as such, the problem of accumulation of spilled toners at the bottom of the base 14 is eliminated, and the problem of malfunctioning of the toner end sensor 11 due to such spilled toners is successfully eliminated.

Figure 9A:
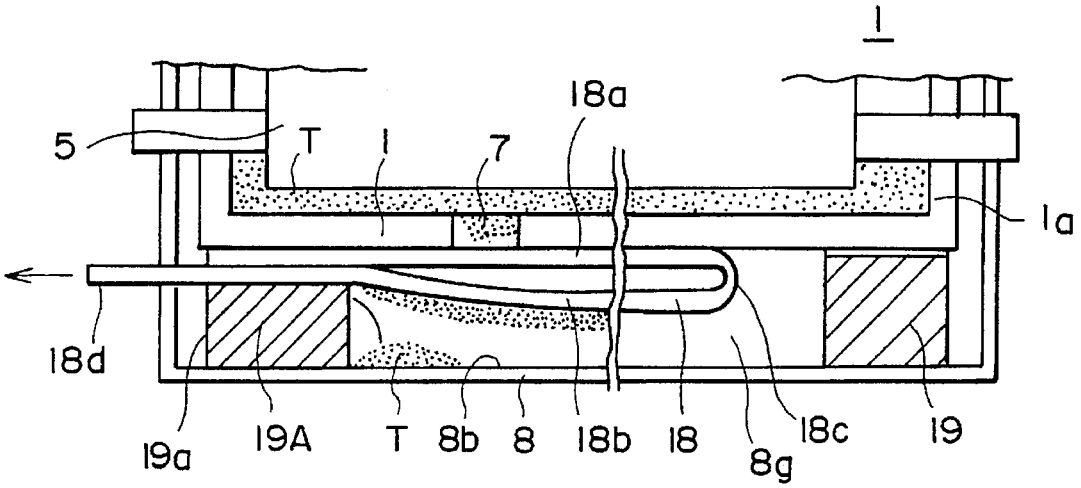
FIGS. 9A and 9B are diagrams showing the construction of a toner cartridge according to a fourth embodiment of the present invention respectively in a longitudinal cross sectional view and a perspective view.
Figure 9B:
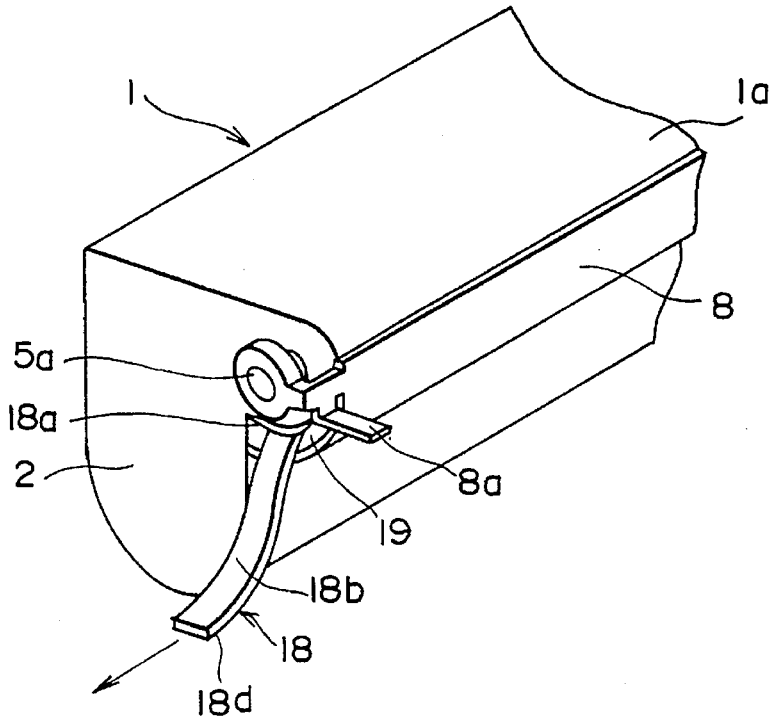

FIGS. 9A and 9B show a fourth embodiment of the present invention. In FIGS. 9A and 9B, those parts corresponding to the parts described previously are designated by the same reference numerals and the description thereof will be omitted. It should be noted that FIG. 9B shows a part of the toner cartridge 1 in a perspective view, while FIG. 9A shows the toner cartridge 1 in a cross sectional view.

Referring to FIGS. 9A and 9B, the toner cartridge 1 includes a seal tape 18 for sealing the toner outlet 7 such that the toners T in the toner tank 2 do not spill from the toner outlet 7 during the transport of the toner cartridge 1. When mounting the toner cartridge 1 newly upon a xerographic recording apparatus, the user of the recording apparatus removes the seal tape 18.

In the construction of FIGS. 9A and 9B, it will be noted that the seal tape 18 is folded at a crease 18*c* and includes an upper part 18*a* attached to the outer surface of the tank 2 for sealing the toner outlet 7 and a lower part 18*b* continuing to the upper part 18*a* at the crease 18*c*, wherein the lower part 18*b* has an exposed end exposed at the side of the toner cartridge 1. The exposed end of the tape 18 forms a tab 18*d* to be pulled by the user when the cartridge 1 is mounted upon the xerographic recording apparatus. In the construction of FIG. 9A, it will be noted that the upper part 18*a* of the seal tape 18 peels off from the toner tank 2 as the tab 18*d* is pulled in the direction of arrows in FIGS. 9A and 9B. In correspondence to the pulling of the tab 18*d*, the position of the crease 18*c* moves to the left in the illustration of FIG. 9A.

When the tape 18 is pulled as such, the lower surface of the tape part 18*b*, which has previously been contacted to the toner tank 2 as the upper surface of the tape part 18*a*, tends to carry toners particularly in correspondence to the part that has closed the toner outlet 7. Thus, when the tape 18 is pulled out as indicated by the arrow in FIG. 9A or 9B, the toners on the lower surface of the tape part 18*b* tend to cause a stain outside the cartridge 1.

Figure 1:
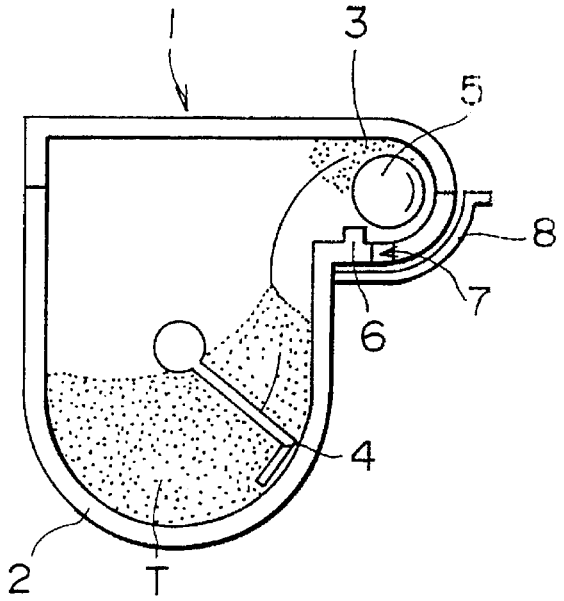
FIG. 1 PRIOR ART
FIG. 1 is a diagram showing the construction of a conventional toner cartridge.
Figure 2:
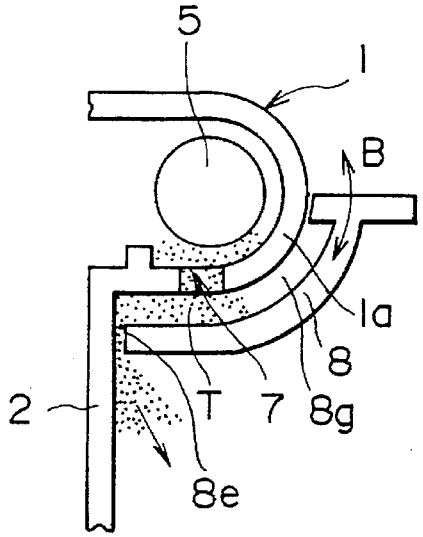
FIG. 2 PRIOR ART
FIG. 2 is a diagram showing a part of the toner cartridge of FIG. 1 in detail.
Figure 3:
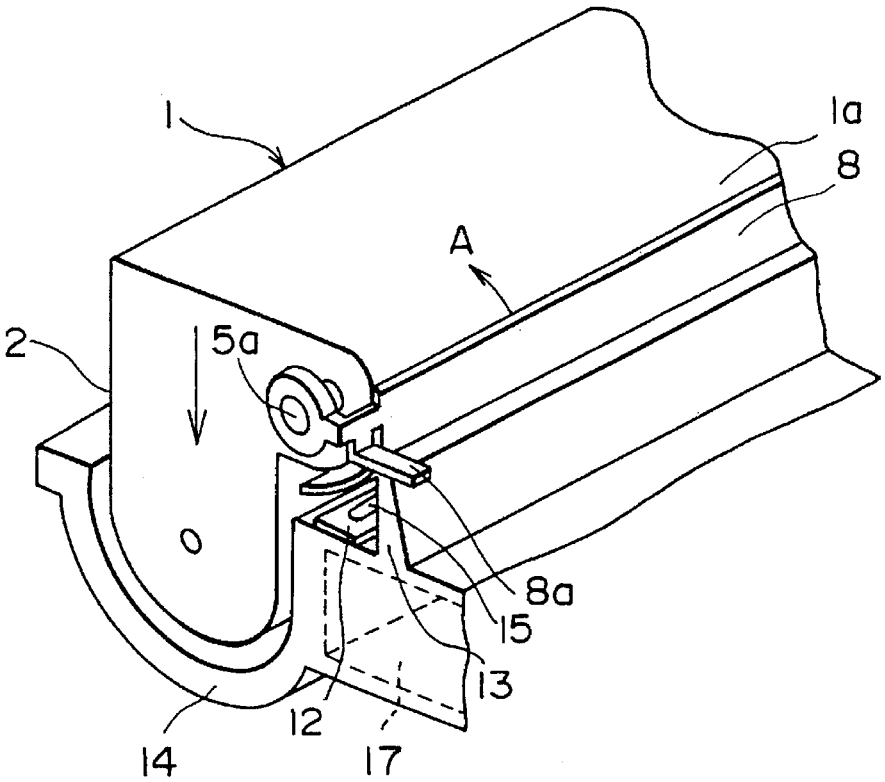
FIG. 3 PRIOR ART
FIG. 3 is a diagram showing the conventional toner cartridge of FIG. 1 in a perspective view.

In order to eliminate such a staining or soiling caused by the toners, the present embodiment provides an elastic member 19A on the inner surface of the shutter 8 at a lateral side thereof where the tape 18 is pulled, such that the elastic member 19A engages with the toner cartridge body 1*a*, with the seal tape 18 intervening therebetween. Thereby, the toners on the lower surface of the tape 18*b* are scraped off by the elastic member 19A as the tape is pulled as indicated in FIGS. 9A and 9B. Further, a similar elastic member 19B is provided at the other lateral side of the shutter 8 for engagement with the toner cartridge body 1*a*, such that the toners scraped off by the elastic member 19A is confined in the space 8*g* between the toner cartridge body 1*a* and the shutter 8. The toners T thus accumulated in the space 8*g* fall into the corresponding toner inlet 15 when the cartridge 1 is properly mounted and the shutter 8 is opened as a result of the engagement of the shutter tongue 8*a* and the corresponding rib 13 of the xerographic recording apparatus as indicated in FIG. 3.

Figure 10:
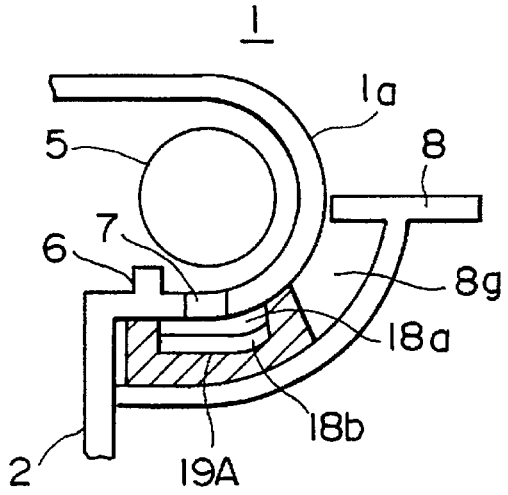
FIG. 10 is a diagram showing the toner cartridge of FIGS. 9A and 9B in a transversal cross sectional view.

FIG. 10 shows the transversal cross section of the toner cartridge 1 of FIG. 9A, taken along a plane that crosses the elastic member 19A. As will be noted from FIG. 10, the tape 18 is folded and the upper tape part 18*a* seals the toner outlet 1*a*, wherein both the upper tape part 18*a* and the lower tape part 18*b* are exposed at a side wall of the member 19A.

In the present embodiment, the elastic member 19A may be formed of any of sponge, foam rubber or fabric such as a felt. Further, the elastic member 19A may be formed of a magnetic material having elasticity similarly to other embodiments.

Figure 11A:
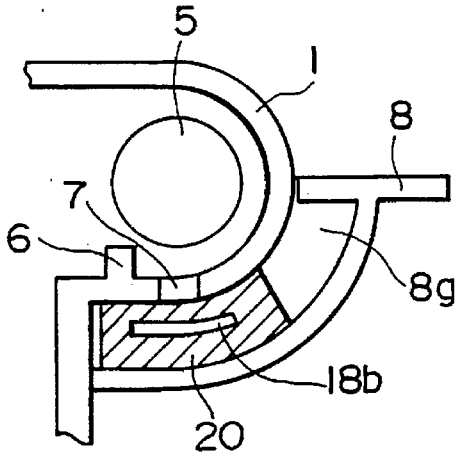
FIGS. 11A and 11B are diagrams showing a modification of the toner cartridge of the fourth embodiment.
Figure 11B:
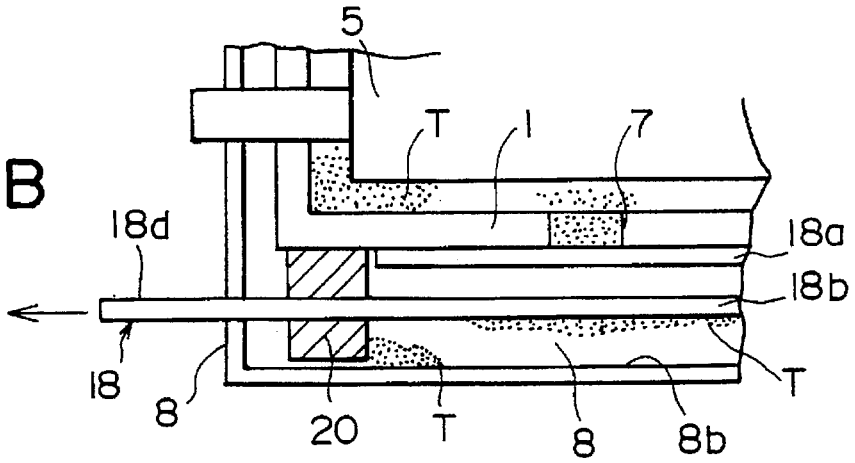

FIGS. 11A and 11B show a modification of the fourth embodiment that uses an elastic member 20 in place of the elastic member 19A, wherein FIG. 11A corresponds to FIG. 10 and FIG. 11B corresponds to FIG. 9A.

Referring to FIGS. 11A and 11B, it will be noted that the upper tape part 18*a* of the seal tape 18 is provided inwardly with respect to the elastic member 20, and the elastic member 20 includes a flat opening or aperture for passing the lower tape part 18*b* therethrough. Thereby, by pulling the tab 18*d* of the tape 18 in the direction of arrow shown in FIG. 18*b*, the seal of the toner outlet 17 is removed while simultaneously eliminating the problem of staining caused by the toners that are carried on the underside of the tape part 18*b*. Similarly as before, the elastic member may be formed of a sponge, foam rubber, fabric such as a felt. Further, the elastic member may be formed of a flexible magnetic sheet.

Figure 12:
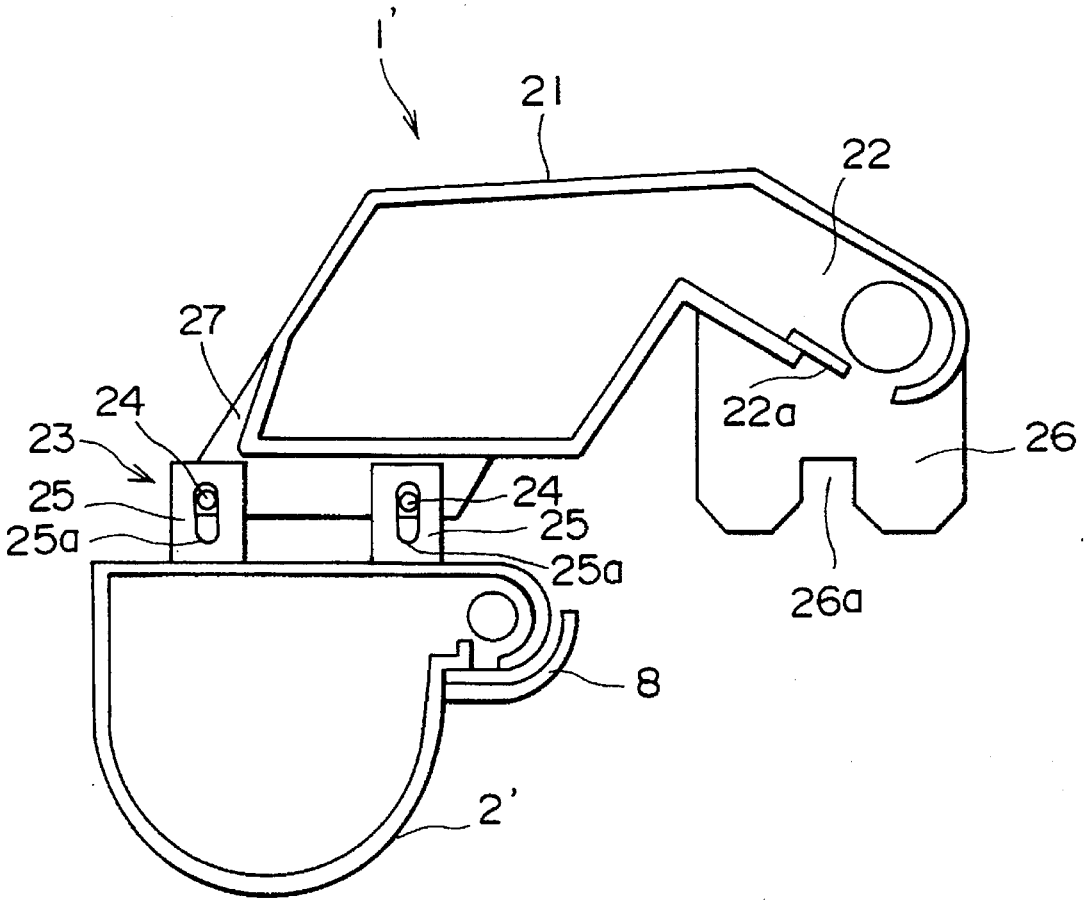
FIG. 12 is a diagram showing the construction of a toner cartridge according to a fifth embodiment of the present invention.

FIG. 12 shows a fifth embodiment of the present invention showing a toner cartridge 1' wherein a toner supply tank 2' and a toner recovery tank 21 are connected with each other to form a unitary body. In FIG. 12, those parts corresponding to the parts described previously are designated by the same reference numerals and the description thereof will be omitted.

Referring to FIG. 12, it will be noted that the toner recovery tank 21 has a connection plate 27 to which corresponding projections 25 of the toner supply tank 2' are connected by means of pins 24. In FIG. 12, each of the projections 25 of the toner supply tank 2' is formed with an elongated opening to which the foregoing pin 24 is engaged. Thereby, the pin 24 connects the projection 25 and hence the toner supply tank 2' and the connection plate 27 and hence the toner recovery tank 21, rigidly. The pin 24, the projection 25 and the connection plate 27 collectively form a connection mechanism 23 that connects the toner supply tank 2' and the toner recovery tank 21 in the form of the toner cartridge 1'.

It should be noted that the toner supply tank 2' has a shutter 8 similar to the one described already with reference to any of the previous embodiments. Thereby, the spillage of the toners from the shutter 8 is minimized. Further, the toner recovery tank 21 includes a cleaning unit 22 that scrapes off the toners from a photosensitive drum of the xerographic recording apparatus on which the toner cartridge 1' is to be mounted. In order to secure proper engagement of the cleaning unit 22 upon the photosensitive drum, the toner recovery tank 21 carries another connection plate 26 that is formed with a cutout 26*a* for engagement with a shaft of the photosensitive drum of the xerographic recording apparatus.

Figure 13:
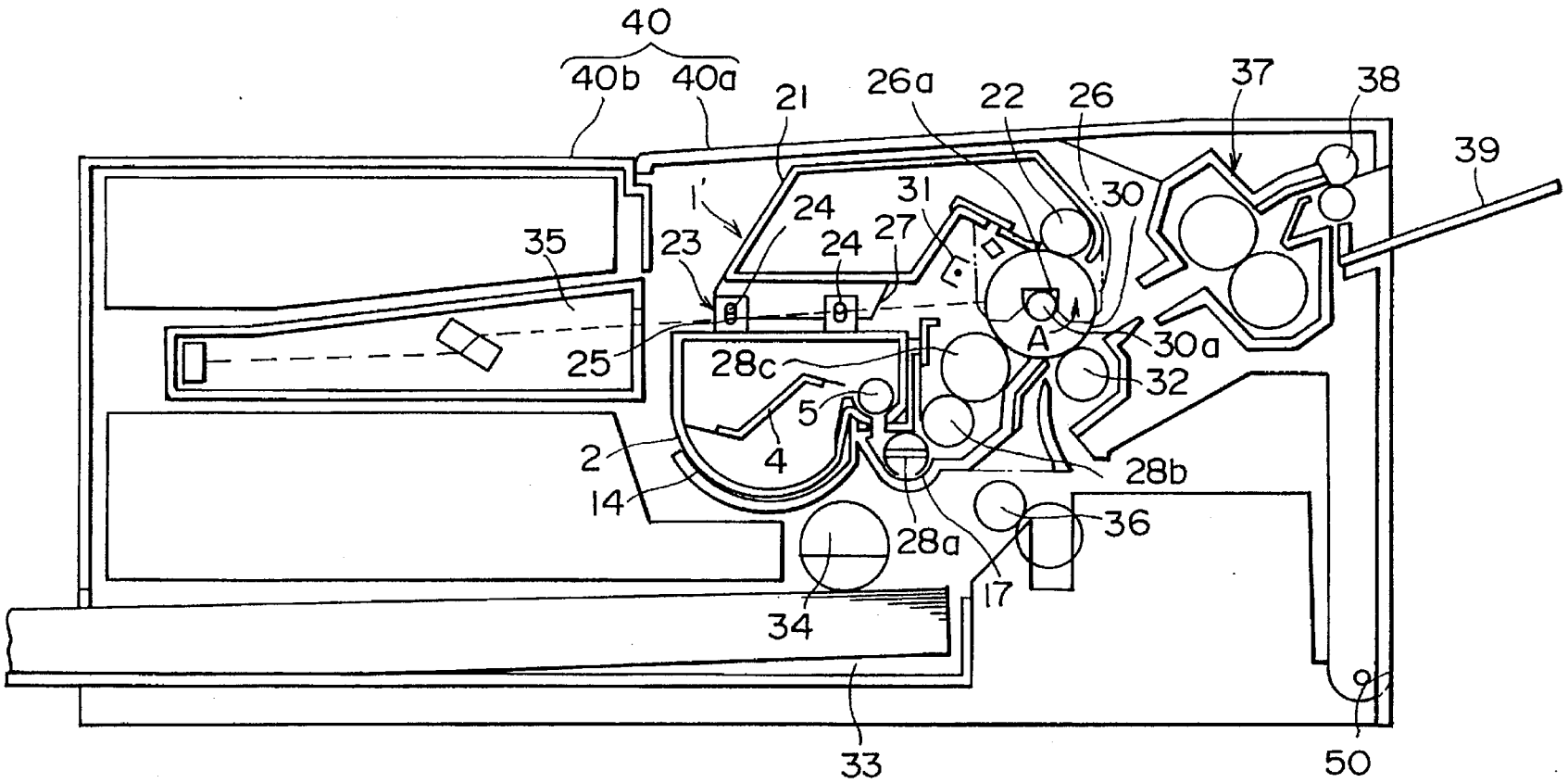
FIG. 13 is a diagram showing the construction of a xerographic recording apparatus that uses the toner cartridge of FIG. 12.

The toner cartridge 1' of FIG. 12 is removably mounted upon a xerographic recording apparatus 40 as indicated in FIG. 13. In FIG. 13, those parts described already are designated by the corresponding reference numerals and the description thereof will be omitted.

Referring to FIG. 13, the xerographic recording apparatus 40 includes an upper body 40*a* and a lower body 40*b* connected with each other movably at a hinge 50.

The upper body 40*a* includes a photosensitive drum 30 in the vicinity of the developing unit 17 for carrying an electrostatic latent image thereon, wherein the developing unit 17 develops the electrostatic latent image on the photosensitive drum 30 in the form of a toner image. The photosensitive drum 30 is further surrounded by a precharging unit 31 for precharging the photosensitive drum 30 at an upstream side of the rotating direction of the photosensitive drum 30 with respect to the developing unit 17, as well as by an image transfer roller 32 that transfers the toner image formed on the photosensitive drum 30 onto a recording sheet. The image transfer roller 32 is provided at a downstream side of the rotating photosensitive drum 30 with respect to the developing unit 17. It should be noted that the writing of the electrostatic latent image by an optical beam is made on the photosensitive drum 30 at a location between the precharging unit 31 and the developing unit 17.

It should be noted that the developing unit 17 includes a toner stirrer 28*a* that supplies the toners received from the toner outlet 7 of the cartridge 1' to a toner transfer roller 28*b*, wherein the toner transfer roller 28*b* supplies the toners further to another toner transfer roller 28*c*. The toner transfer roller 28*c* in turn supplies the toners further to the photosensitive drum 30.

As noted above, the photosensitive drum 30 engages with the cleaning unit 22 of the toner recovery tank 21 in the state where the toner cartridge 1' is mounted properly upon the xerographic recording unit. Thereby, a blade 22*a* of the cleaning unit 22 of FIG. 12 scrapes off the toners from the photosensitive drum 30 at a further downstream side location of the rotating photosensitive drum 30. The cleaning blade 22*a* in turn is located in the upstream side of the precharging unit 31. In FIG. 13, it will also be noted that the cut 26*a* of the plate 26 of the cartridge 1' engages with a shaft 30*a* of the photosensitive drum 30 for proper positioning of the cartridge 1' with respect to the drum 30.

The lower body 40*a* of the xerographic recording apparatus includes an optical system 35 that produces an optical beam according to the image to be recorded, wherein the optical system 35 scans the photosensitive drum 30 by the optical beam at the location between the precharging unit 31 and the developing unit 17 as explained before. Further, the lower body 40*a* includes a removable sheet cassette 33 for holding recording sheets, wherein each of the sheets therein is picked up by a feed roller 34 one by one and is supplied to a sheet feed path in the upper body 40*b* that includes a resist roller 36 that adjusts the timing of feeding the sheet to the transfer roller 32 in synchronization with the rotation of the photosensitive drum 30. The transfer roller 32 presses the sheet supplied thereto to the photosensitive drum 30 for the transfer of the toner image from the drum 30 to the sheet, and the sheet thus recorded with the toner image is then fed to a fixing unit 37 provided on the upper body 40*a* for fixing. The sheet thus fixed with the toner image is then supplied to a discharge roller 38 also provided on the upper body 40*a* for discharging out from the xerographic recording apparatus 40. The sheets thus discharged are collected upon a tray 39.

Further, the present invention is by no means limited to the embodiments described before, but various variations and modifications may be made without departing from the scope of the invention.

What is claimed is:

1. A toner cartridge of a xerographic recording apparatus, comprising:

a toner cartridge body for accommodating toner therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding toner in said toner cartridge body to said toner inlet of said xerographic recording apparatus via said toner outlet; and a shutter mechanism movably provided on said toner cartridge body for closing said toner outlet, said shutter mechanism including a shutter element defined by a free shutter edge and movable between a closed position and an opened position along an outer surface of said toner cartridge body over a part thereof that includes said toner outlet, such that said toner outlet is covered by said shutter element when in said closed position of said shutter element and such that said toner outlet is exposed when in said opened position of said shutter element, said free shutter edge engaging with a part of said toner cartridge body in said closed position thereof to define a closed space between said shutter element and said outer surface of said toner cartridge body, such that said shutter element prevents spillage of toner from said toner outlet;

wherein said shutter element further carries a magnetic member for preventing spillage of toner accumulated in said space between said shutter element and said outer surface of said toner cartridge body, from said free shutter edge.

2. A toner cartridge as claimed in claim 1, wherein said member for preventing spillage is formed on a side of said shutter element that faces said outer surface of said cartridge body, along said free shutter edge of said shutter element.

3. A toner cartridge as claimed in claim 2, wherein said member has a principal surface facing said outer surface of said cartridge body along which said shutter element is moved and a front edge for abutting engagement with a part of said cartridge body when in said closed position.

4. A toner cartridge as claimed in claim 2, wherein said member is formed of a deformable magnetic material.

5. A toner cartridge as claimed in claim 2, wherein said member is formed as an integral body of said shutter element.

6. A toner cartridge as claimed in claim 2, wherein said toner cartridge further includes a removable seal member provided on said toner cartridge body for sealing said toner inlet.

7. A toner cartridge as claimed in claim 1, wherein said toner cartridge further includes a toner tank provided in said toner cartridge body for holding toner, an agitator provided in said toner tank for agitating the toner therein, said agitator further supplying said toner to said toner supply mechanism, and wherein said toner supply mechanism includes a toner roller provided rotatably on said toner cartridge body for carrying the toner thereon and a toner scraping rib provided on said cartridge body in engagement with said toner roller for scraping said toner therefrom, said toner roller being provided such that said toner scraped from said toner roller by said toner scraping rib is supplied to said toner outlet.

8. A toner cartridge as claimed in claim 1 further including a toner recovery tank for recovering toner from said xerographic recording apparatus such that said toner recovery tank is connected to said toner cartridge body by a connection member, said toner recovery tank including a cleaning unit for engagement with a photosensitive body of said xerographic recording apparatus when said toner cartridge is mounted thereupon.

9. A toner cartridge of a xerographic recording apparatus, comprising:

a toner cartridge body for accommodating toner therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding toner in said toner cartridge body to said toner inlet of said xerographic recording apparatus via said toner outlet; and a shutter mechanism movably provided on said toner cartridge body for closing said toner outlet, said shutter mechanism including a shutter element defined by a free shutter edge and movable between a closed position and an opened position along an outer surface of said toner cartridge body over a part of said toner cartridge body that includes said toner outlet, such that said toner outlet is covered by said shutter element when in said closed position of said shutter element and such that said toner outlet is exposed when in said opened position of said shutter element, said free shutter edge engaging with a part of said toner cartridge body in said closed position thereof to define a closed space between said shutter element and said outer surface of said toner cartridge body, such that said shutter element prevents spillage of toner from said toner outlet;

wherein said toner cartridge body further carries a member for engagement with said free shutter edge of said shutter element in said closed position of said shutter element, for preventing a spillage of toner accumulated in said space between said shutter element and said outer surface of said toner cartridge body, from said free shutter edge.

10. A toner cartridge as claimed in claim 9, wherein said member comprises a deformable magnetic material.

11. A toner cartridge as claimed in claim 9 further including a toner recovery tank for recovering toner from said xerographic recording apparatus such that said toner recovery tank is connected to said toner cartridge by a connection member, said toner recovery tank including a cleaning unit for engagement with a photosensitive body of said xerographic recording apparatus when said toner cartridge is mounted thereupon.

12. A toner cartridge of a xerographic recording apparatus, comprising:

a toner cartridge body for accommodating toner therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding toner in said toner cartridge body to said toner inlet of said xerographic recording apparatus via said toner outlet; and a shutter mechanism movably provided on said toner cartridge body for closing said toner outlet, said shutter mechanism including a shutter element defined by a free shutter edge and movable between a closed position and an opened position along an outer surface of said toner cartridge body over a part of said toner cartridge body that includes said toner outlet, such that said toner outlet is covered by said shutter element when in said closed position of said shutter element and such that said toner outlet is exposed when in said opened position of said shutter element, said free shutter edge engaging with a part of said toner cartridge body in said closed position thereof to define a closed space between said shutter element and said outer surface of said toner cartridge body, such that said shutter element prevents a spillage of toner from said toner outlet;

wherein said toner cartridge body further carries a magnetic member on a part thereof located below a part of said toner cartridge body to which said free shutter edge of said shutter element engages in said closed position of said shutter element, said magnetic member thereby collecting toner spilled from said free shutter edge of said shutter element.

13. A toner cartridge as claimed in claim 12 further including a toner recovery tank for recovering toners from said xerographic recording apparatus such that said toner recovery tank is connected to said toner cartridge by a connection member, said toner recovery tank including a cleaning unit for engagement with a photosensitive body of said xerographic recording apparatus when said toner cartridge is mounted thereupon.

14. A toner cartridge of a xerographic recording apparatus, comprising:

a toner cartridge body for accommodating toner therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding toner in said toner cartridge body to said toner inlet of said xerographic recording apparatus via said toner outlet;

a shutter mechanism movably provided on said toner cartridge body for closing said toner outlet, said shutter mechanism including a shutter element defined by a free shutter edge and movable between a closed position and an opened position along an outer surface of said toner cartridge body over a part thereof that includes said toner outlet, such that said toner outlet is covered by said shutter element when in said closed position of said shutter element and such that said toner outlet is exposed when in said opened position of said shutter element, said free shutter edge engaging with a part of said toner cartridge body in said closed position thereof to define a closed space between said shutter element and said outer surface of said toner cartridge body, such that said shutter element prevents a spillage of toner from said toner outlet; and a seal tape provided removably upon said toner cartridge body for closing said toner outlet, said seal tape having a free tab region for removing said seal tape;

wherein said shutter element further carries a member for engagement with said seal tape for scraping off toner attached to said seal tape into said space between said shutter element and said toner cartridge body when said seal tape is pulled at said tab.

15. A toner cartridge as claimed in claim 14, wherein said seal tape comprises an upper tape part in contact with said toner cartridge body for sealing said toner outlet and a free lower tape part continuing from said upper tape part and folded with respect said upper tape part, said lower tape part having said tab at a free end thereof, wherein said member engages with said lower tape part and scrapes toner attached to said lower tape part.

16. A toner cartridge as claimed in claim 14, wherein said member comprises an elastic material.

17. A toner cartridge as claimed in claim 14, wherein said member comprises a magnetic material.

18. A toner cartridge as claimed in claim 14, further including a toner recovery tank for recovering toners from said xerographic recording apparatus such that said toner recovery tank is connected to said toner cartridge body by a connection member, said toner recovery tank including a cleaning unit for engagement with a photosensitive body of said xerographic recording apparatus when said toner cartridge is mounted thereupon.

19. A xerographic recording apparatus, comprising:

a photosensitive body for carrying an electrostatic latent image thereon;

an optical system for writing an electrostatic latent image upon said photosensitive body;

a precharging unit for precharging the photosensitive body;

a developing unit for developing the electrostatic latent image on said photosensitive body in the form of a toner image;

a transfer unit for transferring and fixing said toner image on said photosensitive body upon a recording sheet; and a sheet feed mechanism for feeding a recording sheet to said transfer unit for recording of said toner image said sheet feed mechanism further discharging said recording sheet after recording of said toner image;

said xerographic recording apparatus being adapted for engaging with a toner cartridge mounted thereupon, said toner cartridge comprising:

a toner cartridge body for accommodating toner therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding toner in said toner cartridge body to said toner inlet of said xerographic recording apparatus via said toner outlet; and a shutter mechanism movably provided on said toner cartridge body for closing said toner outlet, said shutter mechanism including a shutter element defined by a free shutter edge and movable between a closed position and an opened position along an outer surface of said toner cartridge body over a part thereof that includes said toner outlet, such that said toner outlet is covered by said shutter element when in said closed position of said shutter element and such that said toner outlet is exposed when in said opened position of said shutter element, said free shutter edge engaging with a part of said toner cartridge body in said closed position thereof to define a closed space between said shutter element and said outer surface of said toner cartridge body, such that said shutter element prevents spillage of toner from said toner outlet;

said shutter element carrying a magnetic member for preventing a spillage of toner accumulated in said space between said shutter element and said outer surface of said toner cartridge body, from said free shutter edge.

20. A xerographic recording apparatus, comprising:

a photosensitive body for carrying an electrostatic latent image thereon;

an optical system for writing an electrostatic latent image upon said photosensitive body;

a precharging unit for precharging the photosensitive body;

a developing unit for developing the electrostatic latent image on said photosensitive body in the form of a toner image;

a transfer unit for transferring and fixing said toner image on said photosensitive body upon a recording sheet; and a sheet feed mechanism for feeding a recording sheet to said transfer unit for recording of said toner image, said sheet feed mechanism further discharging said recording sheet after recording of said toner image;

said xerographic recording apparatus having a seat for engaging with a toner cartridge mounted thereupon, said toner cartridge comprising:

a toner cartridge body for accommodating toner therein, said toner cartridge body having a shape in conformity with a shape of said seat of said xerographic recording apparatus;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding toner in said toner cartridge body to said toner inlet of said xerographic recording apparatus via said toner outlet; and a shutter mechanism provided on said toner cartridge body for movably closing said toner outlet; and a magnetic member provided on a part of said toner cartridge body that faces said seat, for capturing toner falling through a gap formed between said toner cartridge body and said seat.

21. A toner cartridge for a xerographic recording apparatus having a toner developing unit, the toner cartridge comprising:

a cartridge body having a toner outlet for discharge of toner therein, said cartridge body being mountable on the toner developing unit such that said toner outlet is positioned for feeding the discharged toner to the developing unit;

a shutter movable for selectively covering and uncovering said toner outlet; and a magnetic toner retaining element mounted between said shutter and said cartridge body when said shutter is moved to a position for covering said toner outlet.

22. The toner cartridge of claim 21 wherein said toner retaining element is positioned to seal with respect to an edge of said shutter.

23. The toner cartridge of claim 21 wherein said toner retaining element is mounted to said cartridge body.

24. The toner cartridge of claim 23 wherein said toner retaining element is formed of a deformable magnetic material.

25. A toner supply and recovery unit for a xerographic recording apparatus having a toner developing unit and a photosensitive member, comprising:

a toner supply tank having a toner outlet for discharge of toner therein, a cartridge body being mountable on the toner developing unit such that said toner outlet is positioned for feeding the discharged toner to the developing unit;

a toner recovery tank connected to the toner supply tank;

a shutter movable for selectively covering and uncovering said toner outlet; and a magnetic toner retaining element mounted between said shutter and said toner supply tank when said shutter is moved to a position for covering said toner outlet.

26. The toner supply and recovery unit of claim 25 wherein said toner retaining element is positioned to seal with respect to an edge of said shutter.

27. The toner supply and recovery unit of claim 25 wherein said toner retaining element is mounted to said toner supply tank.

28. The toner supply and recovery unit of claim 25 wherein said toner retaining element is formed of a deformable magnetic material.

29. A xerographic recording apparatus comprising:

a toner developing unit;

a photosensitive member; and a toner supply and recovery unit including a toner supply tank having a toner outlet for discharge of toner therein, a cartridge body being mountable on the toner developing unit such that said toner outlet is positioned for feeding the discharged toner to the developing unit, a toner recovery tank connected to the toner supply tank, a shutter movable for selectively covering and uncovering said toner outlet, and a magnetic toner retaining element mounted between said shutter and said toner supply tank when said shutter is moved to a position for covering said toner outlet.

30. The xerographic recording apparatus of claim 29 wherein said toner retaining element is positioned to seal with respect to an edge of said shutter.

31. The xerographic recording apparatus of claim 29 wherein said toner retaining element is mounted to said toner supply tank.

32. The xerographic recording apparatus of claim 29 wherein said toner retaining element is formed of a deformable magnetic material.

33. A toner cartridge for a xerographic recording apparatus having a toner developing unit, the toner cartridge comprising:

a cartridge body having means including a toner outlet for discharging toner therein to the developing unit when the cartridge is mounted to the toner developing unit;

shutter means movable for selectively covering and uncovering said toner outlet; and magnetic toner retaining means for preventing leakage between said shutter means and said cartridge body when said shutter means is moved to a position for covering said toner outlet.

34. The toner cartridge of claim 33 wherein said toner retaining means is positioned to seal with respect to an edge of said shutter means.

35. The toner cartridge of claim 33 wherein said toner retaining means is mounted to said cartridge body.

36. The toner cartridge of claim 33 wherein said toner retaining means is formed of a deformable magnetic material.

37. A toner cartridge for a xerographic recording apparatus having a toner developing unit including a recessed portion and a sensor positioned near the bottom of the recessed portion for sensing the amount of toner in the toner cartridge, the toner cartridge comprising a cartridge body having a toner outlet for discharge of toner therein, said cartridge body being mountable at the recessed portion of the toner developing unit such that said toner outlet is positioned for feeding the discharged toner to the developing unit, wherein a lower part of said cartridge body is configured so as to engage the sensor of the xerographic recording apparatus when said cartridge body is mounted at the recessed portion.

38. The toner cartridge of claim 37 connected to a toner recovery tank.

39. A xerographic recording apparatus comprising:

a toner developing unit including a recessed portion;

a toner cartridge comprising a cartridge body having a toner outlet for discharge of toner therein, said cartridge body being mounted at the recessed portion of the toner developing unit such that said toner outlet is positioned for feeding the discharged toner to the developing unit; and a sensor positioned near the bottom of the recessed portion for sensing the amount of toner in the cartridge body, wherein a lower part of said cartridge body is configured so as to engage the sensor.

40. A toner cartridge for a xerographic recording apparatus having a toner developing unit, the toner cartridge comprising:

a cartridge body having a toner outlet for discharge of toner therein, said cartridge body being mountable on the toner developing unit such that said toner outlet is positioned for feeding the discharged toner to the developing unit;

a shutter movable for selectively covering and uncovering said toner outlet; and a seal tape mounted for sealing said toner outlet and covered by said shutter when said shutter is in a position for covering said toner outlet, said seal tape having a tab portion which is not covered by said shutter when said shutter is in a position for covering said toner outlet so that said seal tape may be removed from the toner cartridge.

41. The toner cartridge of claim 40 wherein said seal tape is folded.

42. The toner cartridge of claim 40, further comprising a scraping member mounted to said shutter at a position for scraping toner from said seal tape when the seal tape is removed from the toner cartridge.

43. The toner cartridge of claim 42 further comprising means for confining toner scraped by said scraping member.

44. A xerographic recording apparatus comprising:

a toner developing unit;

a toner cartridge mounted to said toner developing unit and comprising a cartridge body having a toner outlet for discharge of toner therein, said cartridge body being mountable on the toner developing unit such that said toner outlet is positioned for feeding the discharged toner to the developing unit, and a shutter movable for selectively covering and uncovering said toner outlet; and a seal tape mounted for sealing said toner outlet and covered by said shutter when said shutter is in a position for covering said toner outlet, said seal tape having a tab portion which is not covered by said shutter when said shutter is in a position for covering said toner outlet so that said seal tape may be removed from the toner cartridge.

45. The xerographic recording apparatus of claim 44 wherein said seal tape is folded.

46. The xerographic recording apparatus of claim 44, further comprising a scraping member mounted to said shutter at a position for scraping toner from said seal tape when the seal tape is removed from the toner cartridge.

47. The xerographic recording apparatus of claim 46 further comprising means for confining toner scraped by said scraping member.

48. A method of mounting a toner cartridge to a xerographic recording apparatus having a toner developing unit, the toner cartridge comprising a cartridge body having a toner outlet for discharge of toner therein, said cartridge body being mountable to the toner developing unit such that said toner outlet is positioned for feeding the discharged toner to the developing unit, and a shutter movable for selectively covering and uncovering said toner outlet, comprising the steps of:

pulling a tab of a seal tape mounted for sealing said toner outlet and covered by said shutter when said shutter is in a position for covering said toner outlet,so that said seal tape is removed from the toner cartridge; and mounting said toner cartridge to said toner developing unit while moving said shutter to uncover said toner outlet.

49. The method of claim 48 including the steps of scraping toner from said seal tape when the seal tape is removed from the toner cartridge and retaining the scraped toner in the shutter.

50. A toner cartridge of a xerographic recording apparatus, comprising:

a toner cartridge body for accommodating toner therein;

a toner outlet provided on said toner cartridge body as an opening formed on said toner cartridge body, said toner outlet being adapted for engagement with a corresponding toner inlet of said xerographic recording apparatus;

a toner supply mechanism provided on said toner cartridge body for feeding toner in said toner cartridge body to said toner inlet of said xerographic recording apparatus via said toner outlet; and a shutter mechanism movably provided on said toner cartridge body for closing said toner outlet, said shutter mechanism including a shutter element defined by a free shutter edge and movable between a closed position and an opened position along an outer surface of said toner cartridge body over a part of said toner cartridge body that includes said toner outlet, such that said toner outlet is covered by said shutter element when in said closed position of said shutter element and such that said toner outlet is exposed when in said opened position of said shutter element, said free shutter edge engaging with a part of said toner cartridge body in said closed position thereof to define a closed space between said shutter element and said outer surface of said toner cartridge body, such that said shutter element prevents spillage of toner from said toner outlet;

wherein said toner cartridge body further carries an elastic member for engagement with said free shutter edge of said shutter element in said closed position of said shutter element, for preventing a spillage of said toners accumulated in said space between said shutter element and said outer surface of said toner cartridge body, from said free shutter edge.

* * * * *

UNITED STATES PATENT AND TRADEMARK OFFICE

CERTIFICATE OF CORRECTION

PATENT NO. : 5,671,461

DATED : September 23, 1997

INVENTOR(S) : Tetsuichi ISHII

It is certified that error appears in the above-indentified patent and that said Letters Patent is hereby corrected as shown below:

On the title page, Item [30], the second Foreign Application Date should read:

--March 31, 1995 --.

Signed and Sealed this

Sixth Day of January, 1998

*Attest:*

Bruce Lehman

BRUCE LEHMAN

*Attesting Officer*

*Commissioner of Patents and Trademarks*